US007566380B2

(12) United States Patent
Snekkenes et al.

(10) Patent No.: US 7,566,380 B2
(45) Date of Patent: Jul. 28, 2009

(54) CONTINUOUS DIGESTER WITH FLUID CIRCULATION

(76) Inventors: Vidar Snekkenes, Herrhagsgatan 62, 652 19 Karlstad (SE); Anders Samuelsson, Barstavagen 36, 663 41 Hammaro (SE)

( * ) Notice: Subject to any disclaimer, the term of this patent is extended or adjusted under 35 U.S.C. 154(b) by 0 days.

(21) Appl. No.: 12/326,922

(22) Filed: Dec. 3, 2008

(65) Prior Publication Data

US 2009/0071615 A1 Mar. 19, 2009

Related U.S. Application Data

(62) Division of application No. 11/462,699, filed on Aug. 5, 2006, now Pat. No. 7,497,927.

(30) Foreign Application Priority Data

Sep. 15, 2005 (SE) ..... 0502042

(51) Int. Cl.
*D21C 3/26* (2006.01)

(52) U.S. Cl. ..... 162/18; 162/19; 162/41; 162/57; 162/246; 162/251; 162/247; 162/263

(58) Field of Classification Search ..... 162/18, 162/19, 41, 57, 246, 251, 247, 263, 237, 162/238

See application file for complete search history.

(56) References Cited

U.S. PATENT DOCUMENTS 5,236,554 A * 8/1993 Greenwood ..... 162/238
6,123,808 A * 9/2000 Bechard et al. ..... 162/18

* cited by examiner

*Primary Examiner*—Mark Halpern
(74) *Attorney, Agent, or Firm*—Rolf Fasth; Fasth Law Offices

(57) ABSTRACT

The arrangement concerns an improved design for at least one of the cooling, dilution and washing at the bottom of a continuous digester for the production of cellulose pulp. By arranging at least one extra strainer section above the lowermost strainer section, with the addition of washing fluid or dilution fluid between the extra strainer section and the lowermost strainer section, more washing fluid can be added at the bottom of the digester without counteracting the flow of the column of chips. This provides space for the increase of production, for improvement of the flow of the column of chips, or for combinations of these effects while retaining good cooling, washing and dilution at the bottom of the digester.

6 Claims, 5 Drawing Sheets

CONTINUOUS DIGESTER WITH FLUID CIRCULATION

PRIOR APPLICATION

This application is a U.S. divisional application claiming priority from U.S. patent application Ser. No. 11/462,699, filed 5 Aug. 2006, now U.S. Pat. No. 7,497,927.

TECHNICAL AREA

The present invention concerns an improvement of the cooling, washing, and exchange of fluid in a continuous digester for the production of cellulose pulp.

THE PRIOR ART

FIG. 1 shows a typical design of the lower part of a continuous digester. A lower strainer section 2 is present in this digester from which consumed cooking fluid is withdrawn from the column of pulp in the digester. Dilution fluid or washing fluid WL is introduced into the bottom of the digester through vertical 4V or horizontal 4H dilution fluid nozzles or washing fluid nozzles. A certain amount of dilution fluid or washing fluid may also be added through nozzles 4Sc in arms of the rotating bottom scraper and through a conventionally central pipe 4C that opens out in the centre of the column of pulp in the digester.

In the prior art design shown in FIG. 1, one or more rows of strainers 3*a*/3*b* may form the actual strainer section, where each row of strainers comprises strainer surfaces 22*a*/22*b* together with a withdrawal volume 20 arranged at each strainer surface, and a collection chamber 21 under the withdrawal volume from which consumed cooking fluid is led away to a recovery system, the flow labelled REC. The collection chamber 21 may be located also outside of the digester shell in what is known as an "external header".

When it is desired to increase the production capacity of the digester, i.e. to increase the number of tonnes of digested pulp per day, the speed of the chips and the column of pulp down through the digester increases, while it is necessary at the same time to withdraw a greater amount of consumed cooking fluid and a greater volume of added dilution fluid or washing fluid from the strainer section.

This results in the lifting force from the upwards flow of fluid established at the bottom counteracting the tendency of the chips and column of pulp to sink, and this leads to the column of pulp easily becoming stuck such that output from the bottom of the digester is made more difficult, and sometimes even ceases completely.

Increasing the amount of dilution fluid or washing fluid added per unit of time at the nozzles 4V/4H/4Sc/4C arranged at the bottom proportionally to the increase of production, with the aim of maintaining a constant degree of dilution and washing per tonne of digested pulp, ensures that the upward lifting force on the chips and column of pulp increases proportionally with the increase in production.

There is thus an upper limit to the production capacity for each digester with a bottom of conventional design with a withdrawal section 2 and with the addition of dilution fluid or washing fluid.

Other types of strainer design for continuous digesters are known, but these have been implemented for particular reasons and they solve totally different problems.

U.S. Pat. No. 5,236,554 reveals a strainer design with which it is desired alternately to add new cooking fluid enriched with chemicals in one of four sections arranged at the periphery of the digester wall around the column of chips, and to withdraw cooking fluid from an opposite sector. The particular addition sector and the particular withdrawal sector of these four sectors are varied over time, such that it possible to reduce radial temperature gradients and obtain an even digestion of the chips over the complete cross-section of the column of chips. The addition sectors can be designed as wall sections lying next to strainer surfaces, with nozzles arranged in these wall sections.

The technology is most suitable at high locations in the digester where it is desired to have internal circulation and adjustment of the alkali profile, and it suffers from the disadvantage that only 25% of the strainer surface seen in the direction of the circumference of the digester is actively used as withdrawal strainer at any moment in time. The technology is not suitable for withdrawal sections in which there is instead a very high demand placed on the strainers (i.e. a large volume of withdrawn cooking fluid per unit of strainer area) around the complete digester, as is the case for the bottom strainer sections in, principally, overloaded digesters.

Thus U.S. Pat. No. 5,236,554 reveals something completely different than adding new cooking fluid enriched with chemicals through central pipes and only withdrawing consumed cooking fluid from the strainers in the wall of the digester, which technology ensures that only chips in the centre of the column of pulp are exposed to fresh cooking fluid and the chips in the column of pulp along the walls of the digester are exposed only to exposed cooking fluid. The technology with crossed or alternating addition and withdrawal around the wall of the digester is a technology that is revealed also in SE 145,257 (dated 1952).

U.S. Pat. No. 6,123,808 describes another variant of the addition of dilution fluid or washing fluid at the bottom of the digester. A dispersion and strainer area that runs around the circumference is used in this case as a distributor of the added dilution fluid or washing fluid, which dispersion and strainer area is arranged directly under the lowermost withdrawal strainer. The aim here is to obtain a more even distribution of dilution fluid or washing fluid around the complete circumference of the digester, in a manner that differs totally from the distribution that can be achieved with local dilution fluid or washing fluid nozzles. An important aspect of this solution is that the relevant dispersion and strainer area must cover a larger diameter than that of the strainer area of the withdrawal strainer positioned above it. The disadvantage of this design is that the injection pressure for fluid into the column of pulp from the dilution fluid or washing fluid that is added though the dispersion and strainer area will be very low. The added dilution fluid or washing fluid can risk also being drawn directly to the strainer that lies above the dispersion and strainer area without passing in practice through any significant volume of pulp or chips in the column of pulp.

THE AIM OF THE INVENTION

The primary aim of the invention is to improve the cooling, dilution and washing principally at the bottom of the digester in continuous digesters.

A second aim is that of being able to increase the production of existing digesters without experiencing problems with the flow of the column of chips in the digester when the volume of dilution fluid or washing fluid that is added at the bottom of the digester increases in proportion with the increase in production while essentially maintaining constant the dilution fluid or washing effect.

A further aim is to reduce the lifting force on the column of chips in the bottom wash, where the upwards flow from the fluid added at the bottom can be reduced by the establishment of several layers of upward flow on top of each other instead of these being formed at the same cross-section of the digester.

A further aim is to be able to establish a further washing zone at the lower part of the digester without needing to reconstruct the central pipe of the digester, which central pipe is always otherwise used in a conventional manner for the addition of digester circulations above the row of strainers located lowermost in the digester.

SUMMARY OF THE INVENTION

The arrangement concerns an improved design for at least one of the cooling, dilution and washing at the bottom of a continuous digester for the production of cellulose pulp. By arranging at least one extra strainer section above the lowermost strainer section, with the addition of washing fluid or dilution fluid between the extra strainer section and the lowermost strainer section, more washing fluid can be added at the bottom of the digester without counteracting the flow of the column of chips. This provides space for the increase of production, for improvement of the flow of the column of chips, or for combinations of these effects while retaining good cooling, washing and dilution at the bottom of the digester.

DETAILED DESCRIPTION OF THE INVENTION

Figure 1:
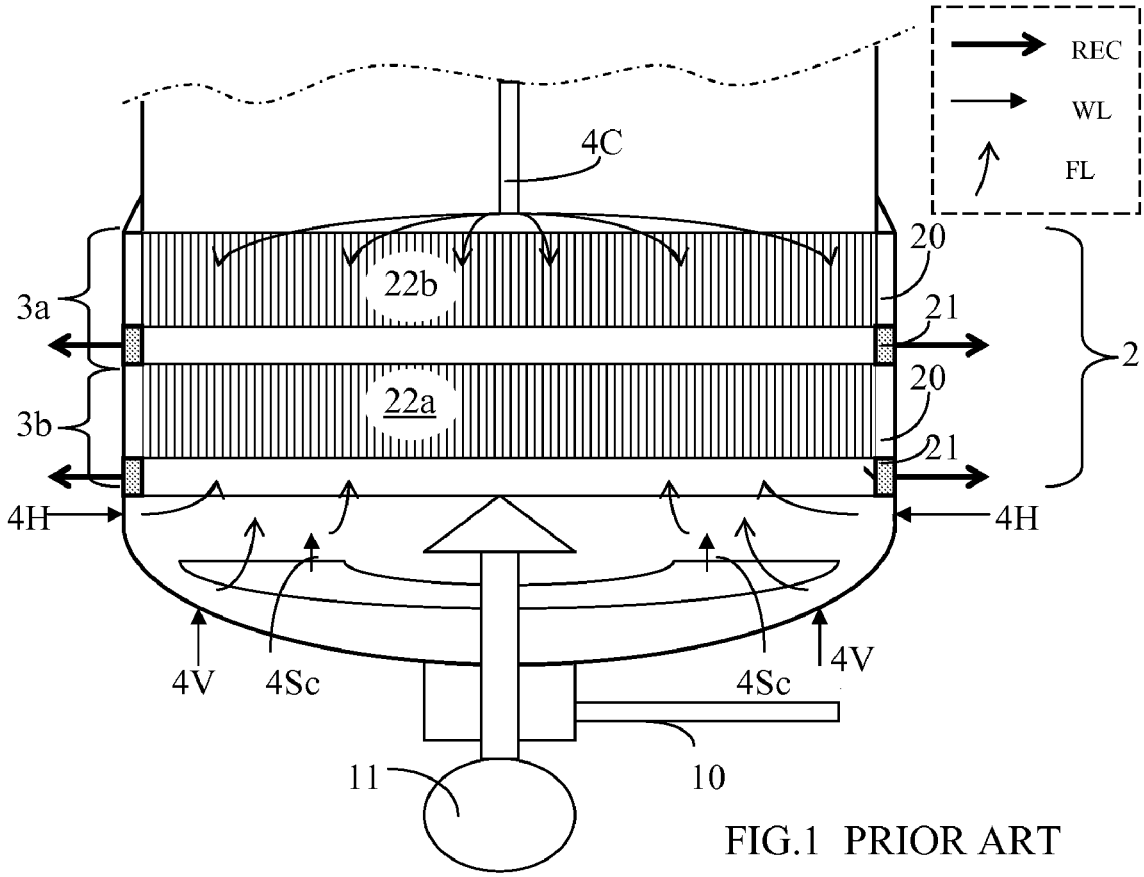
FIG.1 PRIOR ART
FIG. 1 shows a conventional design of a bottom strainer with the addition of dilution fluid at the bottom of a continuous digester.
Figure 2:
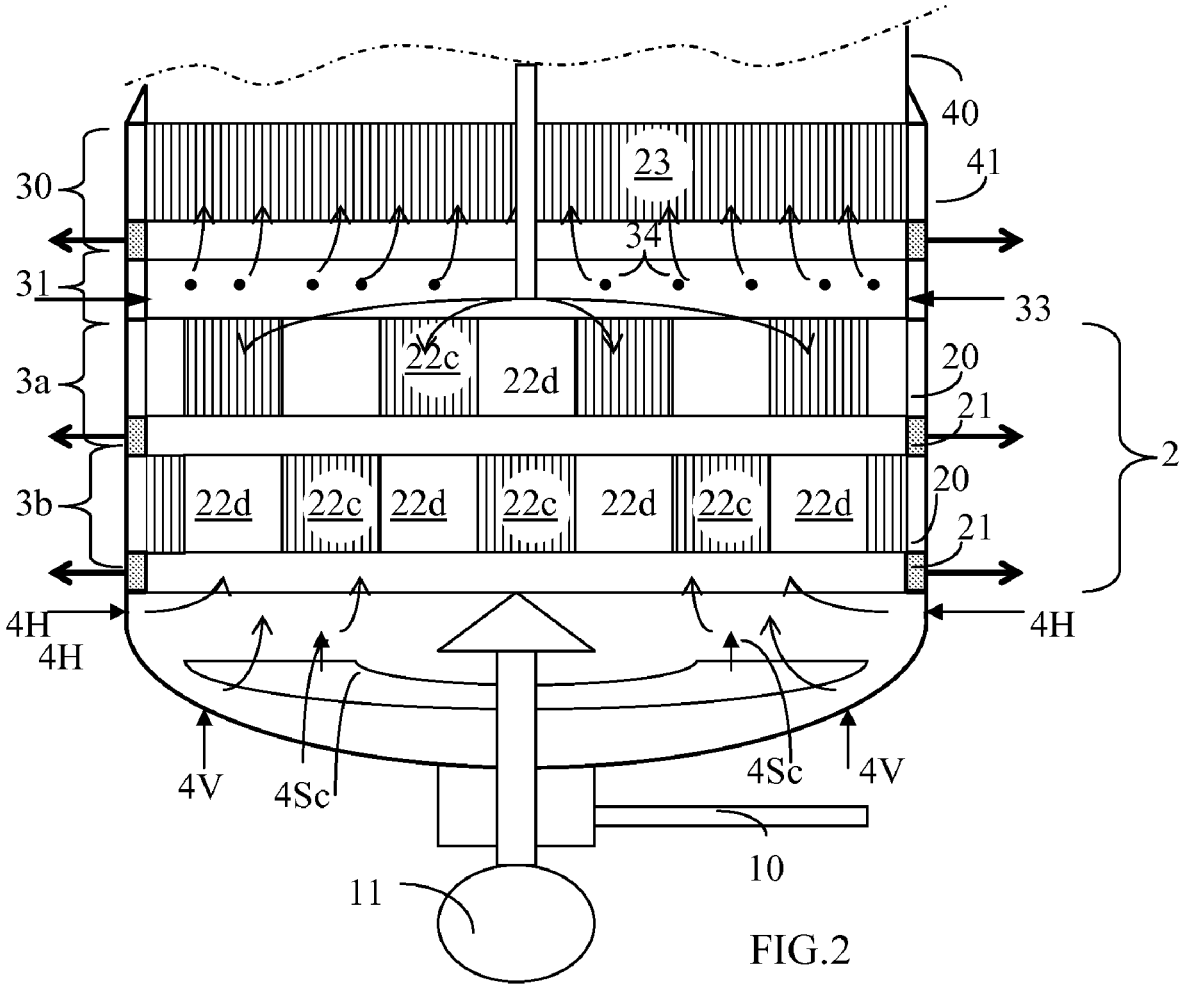
FIG. 2 shows a first embodiment of the invention where an extra row of strainers has been arranged directly above the existing bottom strainer.

FIG. 2 shows a first embodiment of the invention, where the bottom design comprises an arrangement for the addition and withdrawal of fluids to a digester that is used for the continuous cooking of cellulose pulp. Wood chips are continuously fed through an inlet at the top of the digester (not shown in the drawing) and cooked cellulose pulp is continuously output through an outlet 10 at the bottom of the digester. At least one strainer section 2 is arranged in the digester, in association with the bottom of the digester with strainer surfaces 22*c* (or similarly 22*a*, 22*b* in FIG. 1) arranged in the strainer section arranged in the direction of the circumference of the wall of the digester for the withdrawal of consumed cooking fluid. Nozzles 4V, 4H, 4Sc for the addition of dilution fluid or washing fluid are arranged under the lowermost strainer section 2 and between the lowermost strainer section 2 and the outlet 10 arranged in the bottom of the digester. A number of vertically directed nozzles 4V are normally located in the curved bottom end wall of the digester evenly distributed around the circumference. These may typically constitute 10-30 nozzles, or more, in a digester with a diameter of 8 meters.

The vertical nozzles 4V are supplemented with a number of dilution nozzles 4H directed in a horizontal direction that open out into the wall of the digester just above the curved bottom wall but under the lowermost row of strainers. The number of these nozzles may constitute 10-30 in a digester with a diameter of 8 meters.

Addition of dilution fluid or washing fluid takes place in certain digesters also through the rotating bottom scraper through nozzles 4Sc arranged in the bottom scraper. One outlet on each arm is shown in the drawing, but several of these outlets may be present across the arm of the bottom scraper, from the centre of the bottom scraper and out to the outer end of the arm of the bottom scraper.

In addition to these dilution nozzles in the bottom of the digester, there is also an outlet from a central pipe positioned at the level of the lowermost row of strainers 2, often just above this row of strainers, but the flow from this central pipe contributes to the dilution or washing process at the bottom of the digester.

FIG. 2 shows that the strainer section is constituted by strainer surfaces 22*c* that are located in the pattern of the squares of a chessboard, a pattern that is known as "staggered screens", where these strainer surfaces in each row of strainers 3*a*, 3*b* has a blind plate 22*d* between each strainer surface, which blind plate 22*d* has a surface area that essentially corresponds to that of the surrounding strainer surfaces 2*c*. These types of rows of strainer are normally located in strainer sections with several rows of strainers, in which rows of strainers that lie above or below a row of strainers have strainer surfaces that are displaced such that a chessboard pattern is formed. This design is often chosen if it is desired to keep the cost of the strainer section low, while at the same time having a high withdrawal capacity, since it is the case that each strainer surface 22*c* has the capacity to drain the column of chips also in those parts that are located as neighbours to the blind plates, i.e. the strainer surfaces drain the column of chips in the direction of the circumference a good deal into half of the extent of the neighbouring blind plate in the direction of the circumference. The invention can, of course, be used also for strainer sections of the type that is shown in FIG. 1, where each row of strainers is constituted by a continuous strainer surface that runs in the direction of the circumference. All strainer surfaces in this description may be constructed of what are known as "rod strainers" or they may be simpler plates with slits.

At least one extra strainer section 30 is arranged for the withdrawal of consumed cooking fluid according to the invention above the lowermost strainer section 2 at a distance between the uppermost part of the lowermost strainer section 2 and the lowermost part of the extra strainer section 30. Furthermore, a number of extra nozzles 34 are arranged for the addition of dilution fluid or washing fluid distributed around the circumference of the digester between the uppermost part of the lowermost strainer section 2 and the lowermost part of the extra strainer section 30, which extra nozzles are provided with fluid 33 with the aid of pumps, which fluid is continuously added into the column of pulp through the outlets of these nozzles 34.

The distance between the uppermost part of the lowermost strainer section 2 and the lowermost part of the extra strainer section 30 is the distance 31 in FIG. 2, which corresponds to a small section of blind plates where the extra nozzles 34 are arranged: this distance is less than the bottom diameter of the digester. This distance typically lies within the interval 0-8 meters. The variant in which this distance is zero means that the nozzles are located at the interface between the uppermost part of the lowermost strainer section 2 and the lowermost part of the extra strainer section 30.

In one advantageous embodiment, the distance between the uppermost part of the lowermost strainer section 2 and the lowermost part of the extra strainer section 30 is considerably less than the height of the extra strainer section 30, i.e. the distance is less than 2 meters, and preferably less than 1 meter. A normal row of strainers, which may establish the extra strainer section, conventionally has a height of between 1.5 and 2 meters in digesters with production capacities of 1,500-3,000 tonnes per day.

A compact reconstruction of the washing and dilution zone of the digester is obtained in this way that infringes to a minimal degree on the cooking zone that lies above it. The distance can, however, in certain cases be increased if changes to the cooking process are made at the same time, while even so retaining a sufficiently long cooking zone. This applies primarily to those digesters in which what is known as a long "Hi-heat" wash is used at the bottom of the digester, in which the process is changed such that parts of the original Hi-Heat zone are used as cooking zone. This zone may correspond to 30% or more of the total retention time of the chips in the digester, in older digesters with Hi-Heat wash.

Figure 3:
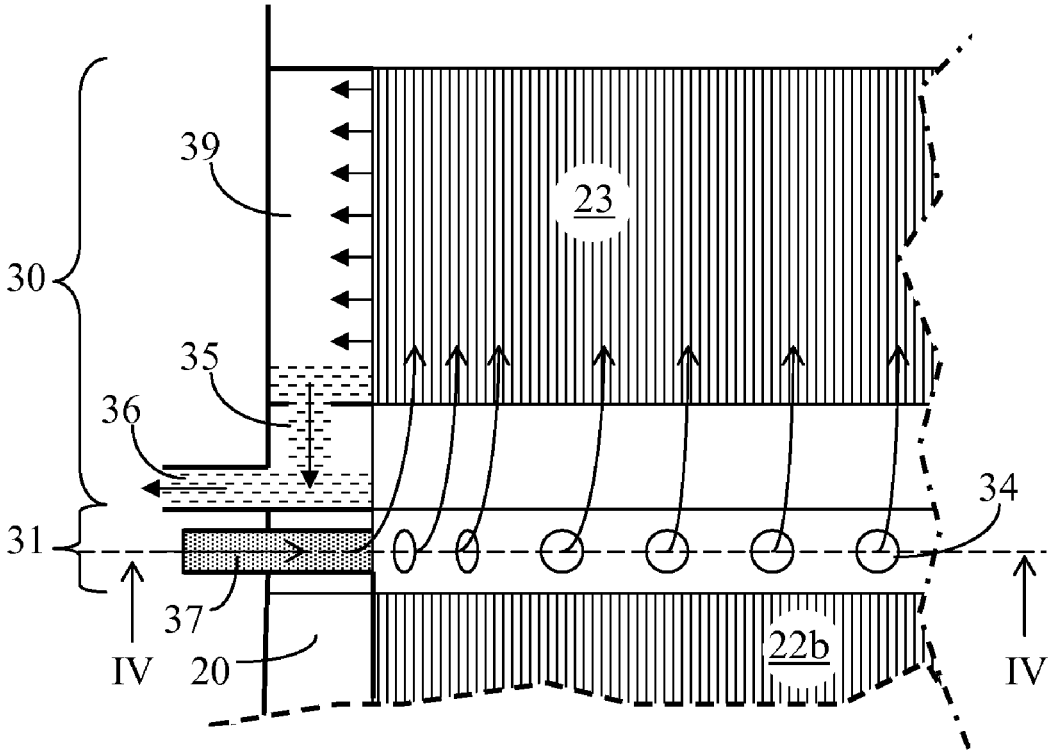
FIG. 3 shows an enlarged view of the design according to FIG. 2.
Figure 4:
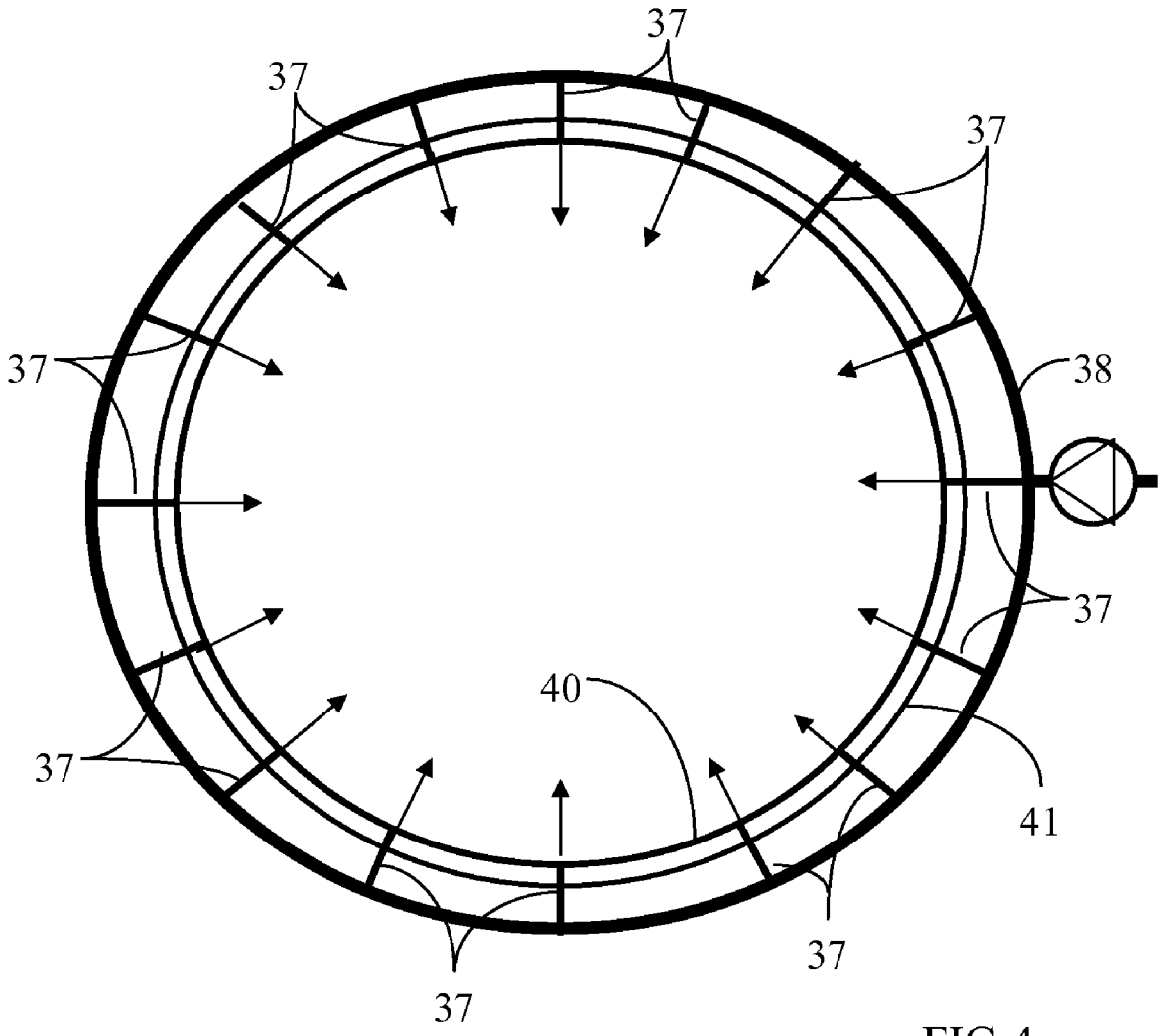
FIG. 4 shows a view seen in the section IV-IV in FIG. 3.

FIG. 3 and FIG. 4 show in more detail the design with the extra nozzles 34 and the withdrawal volume 30. The extra nozzles 34 are located arranged such that their openings have their outlet in the wall 40 of the digester between the uppermost part of the lowermost strainer section and the lowermost part of the extra strainer section. Each extra nozzle 34 is provided by the connecting pipes 37 with dilution fluid or washing fluid from a common distribution channel 38 that runs around the digester, and which is in its turn provided with dilution fluid or washing fluid by a pump shown schematically in FIG. 4.

It is preferable that the strainer surface of the lowermost strainer section 2, the strainer surface of the extra strainer section 30 and the openings of the extra nozzles 34 are all arranged at essentially the same diameter in the wall of the digester, something that is normally the case if manhole strainers are used that have been post-installed.

The extra strainers may otherwise be mounted in an inner digester wall that constitutes a wall section that is extended downwards from a superior strainer section, which means that the strainer surface of the lowermost strainer section 2 and the openings of the extra nozzles 34 are both arranged at essentially the same diameter in the wall of the digester, while the strainer surface of the extra strainer section 30 is located at a smaller diameter in this wall section that has been extended downwards.

The additional extra nozzles 34 are evenly distributed around the circumference of the digester and they are present in such a number that the distance around the circumference between neighbouring extra nozzles is less than 3 meters, preferably less than 2 meters.

It is appropriate that the nozzles have an opening that delivers a concentrated jet into the column of pulp, but they may have openings that are oval or slits in the direction around the circumference. Addition of fluid may, in one extreme variant in which it is desired to achieve greater volumes of added fluid between the extra strainer section and the lower strainer section, also take place through what is essentially one single continuous slit that runs around the circumference. It is advantageous for achieving the best penetration effect into the column of pulp that the slit of the openings of the nozzles are subject to a controlled drop in pressure for the establishment of a high injection velocity of fluid into the column of pulp.

The lower strainer section 2 is constituted by at least one row of strainers, preferably by at least two rows of strainers, as is shown in FIG. 2, where each row of strainers 3*a*, 3*b* consists of strainer plates or rod strainers arranged in the direction of the circumference around the digester. A collecting channel 20 is arranged at each row of strainers 3*a*, 3*b* for the cooking fluid that has been withdrawn through the strainers in this row of strainers, where each collection channel has at least one emptying arrangement 21 for the removal of the withdrawn cooking fluid.

The extra strainer section 30 is constituted by at least one row of strainers 23, where each row of strainers consists of strainer plates or rod strainers arranged in the direction of the circumference around the digester. A collecting channel 39 is arranged at each row of strainers for the cooking fluid that has been withdrawn through the strainers in this row of strainers, where each collection channel has at least one emptying arrangement 35, 36 for the removal of the withdrawn cooking fluid.

Figure 5:
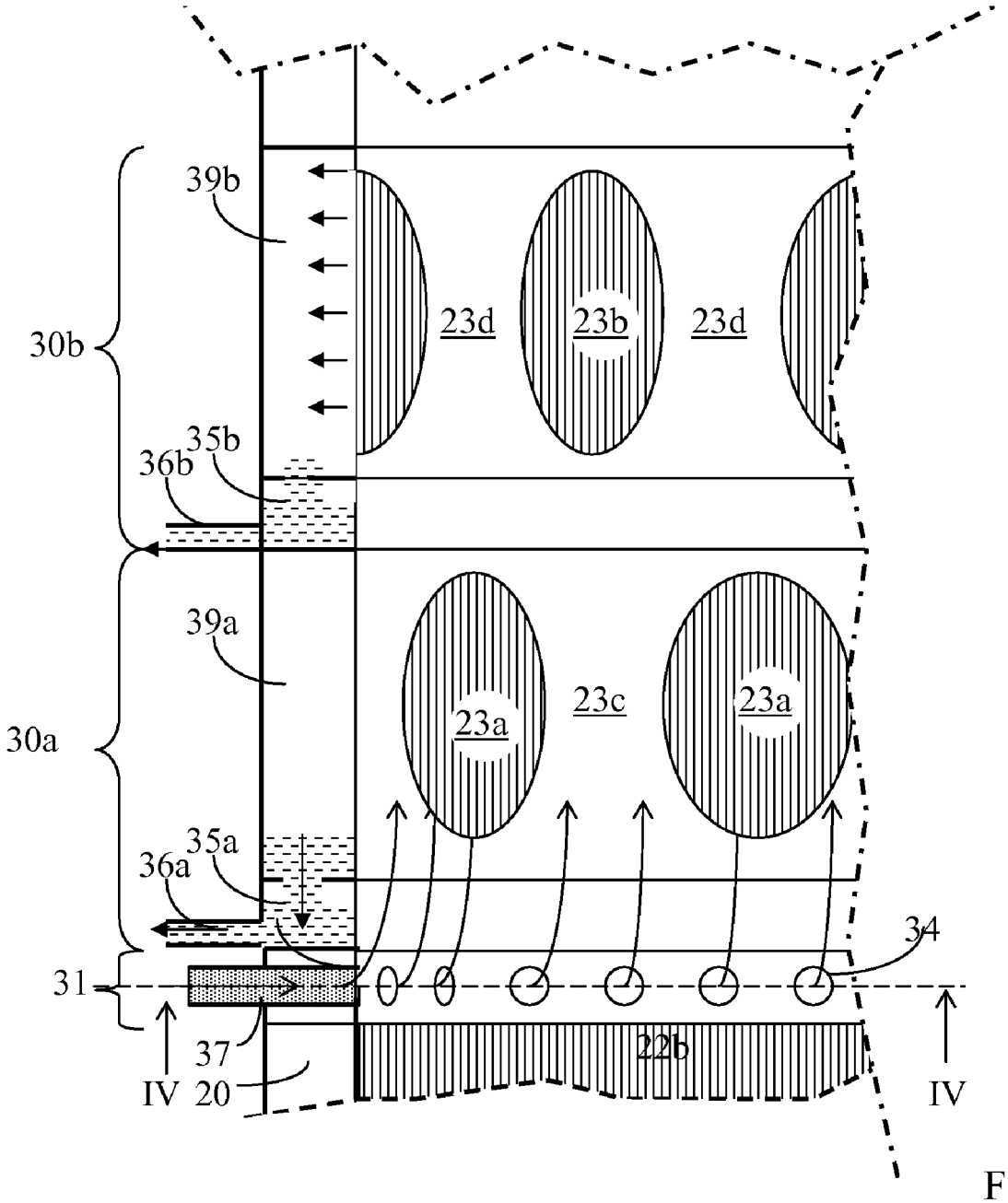
FIG. 5 shows an alternative embodiment of the invention with two extra rows of strainers arranged directly above the existing bottom strainer, where these extra rows of strainers are constituted by round strainers of the type known as "manhole strainers".

Also the extra strainer section 23 may consist of at least one row of strainers with several strainer sections 23*b* where the strainer sectors have wall sections between them in the form of blind plates 23*d* that do not have strainer surfaces. A variant is shown in FIG. 5 in which the strainer sectors are round, of the type known as manhole strainers, and they are arranged in two rows 30*a*, 30*b*. The extra strainer section 23 may also consist of square strainer sectors of the type shown in FIG. 2 for the rows of strainers 3*a*, 3*b*, and arranged in a pattern that forms a chessboard around the circumference of the digester (an arrangement known as staggered screens).

The invention can be modified in a number of ways within the framework of the claims. Several copies of the extra strainer section 30 and the nozzle section 31 may, for example, be located one above the other, such that several positions for the addition of dilution fluid are obtained at several heights in the bottom of the digester.

An extra nozzle section can also be located above the extra row of strainers 30 in the variant that is shown in FIG. 2.

While the present invention has been described in accordance with preferred compositions and embodiments, it is to be understood that certain substitutions and alterations may be made thereto without departing from the spirit and scope of the following claims.

We claim:

1. A method for adding and withdrawing fluids in a final wash stage in a digester, comprising:

providing a digester having an inlet and an outlet defined therein, the digester having a lowermost wash strainer section disposed at a bottom of the digester, the lowermost wash strainer section having a strainer surface arranged along a circumference of an inner wall of the digester, the digester further having an extra wash strainer section disposed above the lowermost wash strainer section inside the digester, the extra wash strainer being spaced away from the lowermost wash strainer section so that a gap is defined therebetween in a gap segment of the digester, continuously feeding wood chips through the inlet at a top of the digester and cooking the wood chips in a cooking fluid to form cellulose pulp in the digester, the lowermost wash strainer section and the extra wash strainer section withdrawing consumed cooking fluid from the digester, a plurality of gap nozzles, disposed in the gap around the circumference of the inner wall of the digester, continuously providing a dilution fluid or a washing fluid radially inwardly into a column of pulp disposed in the gap of the digester, a plurality of bottom nozzles, disposed under the lowermost wash strainer section between the lowermost wash strainer section and the outlet, adding dilution fluid or washing fluid into the column of pulp disposed below the lowermost wash strainer section, and continuously feeding the cellulose pulp through the outlet at the bottom of the digester.

2. The method according to claim 1 wherein the method further comprises the step of pumping dilution fluid or washing fluid into a distribution channel that runs around the inner wall of the digester, the distribution channel being in fluid communication with the gap nozzles.

3. The method according to claim 1 wherein the method further comprises the step of evenly distributing the gap nozzles along the circumference of the digester.

4. The method according to claim 1 wherein the method further comprises the step of each gap nozzle delivering a concentrated jet into the column of pulp.

5. The method according to claim 1 wherein the method further comprises the step of dividing a total volume of wash or dilution liquid added to the bottom of the digester in at least two layered wash stages, each layered wash stage having a strainer section and nozzles for addition of wash or dilution liquid below the strainer section, such that a total lifting force on the column of pulp created by the addition of the total volume of wash or dilution liquid is reduced.

6. A method for adding and withdrawing fluids in a final wash stage in a digester, comprising:

providing a digester having an inlet and an outlet defined therein, the digester having a first wash strainer section and a second strainer section, the first wash strainer section being above the second wash strainer section at a bottom of the digester so that the first and second wash strainer sections each forms a layered wash stage, the first wash strainer section having inwardly directed radial nozzles, disposed between the first and second wash strainer sections, for adding a wash or dilution fluid below the first strainer section, the second wash strainer section having nozzles for adding a wash or dilution fluid below the second strainer section, feeding wood chips through the inlet at a top of the digester and cooking the wood chips in a cooking fluid to form cellulose pulp in the digester, withdrawing consumed cooking fluid from the first and second wash strainer sections, dividing a total volume of the wash or dilution fluid added to the first and second wash strainer sections at the bottom of the digester such that a total lifting force, created by the addition of the total volume on a column of pulp, is reduced, the nozzles, disposed between the first and second wash strainer sections, being disposed around a circumference of an inner wall of the digester, continuously providing a first portion of the total volume of the dilution fluid or a washing fluid radially inwardly into a column of pulp disposed in the digester, the nozzles, disposed under the second wash strainer section between the second wash strainer section and the outlet, adding a second portion of the total volume of the dilution fluid or washing fluid into the column of pulp disposed below the second wash strainer section, and feeding the cellulose pulp through the outlet at the bottom of the digester.

* * * * *